US009850637B2

(12) United States Patent
Ciccotelli

(10) Patent No.: US 9,850,637 B2
(45) Date of Patent: Dec. 26, 2017

(54) DIGGING EQUIPMENT WITH RELATIVE IMPROVED HYDRAULIC SYSTEM

(71) Applicant: SOILMEC S.p.A., Cesena (IT)

(72) Inventor: Valentino Ciccotelli, Cesena (IT)

(73) Assignee: SOILMEC S.P.A., Cesena (FC) (IT)

( * ) Notice: Subject to any disclaimer, the term of this patent is extended or adjusted under 35 U.S.C. 154(b) by 357 days.

(21) Appl. No.: 14/664,023

(22) Filed: Mar. 20, 2015

(65) Prior Publication Data

US 2015/0267371 A1 Sep. 24, 2015

(30) Foreign Application Priority Data

Mar. 24, 2014 (IT) ..... MI2014A0492

(51) Int. Cl.

| | |
|---|---|
| ***E02F 3/20*** | (2006.01) |
| ***E02D 17/13*** | (2006.01) |
| ***E02D 3/12*** | (2006.01) |
| ***E21B 7/02*** | (2006.01) |
| ***E02F 9/22*** | (2006.01) |

(52) U.S. Cl.

CPC ..... *E02D 3/126* (2013.01); *E02F 3/205* (2013.01); *E02F 9/226* (2013.01); *E02F 9/2232* (2013.01); *E02F 9/2292* (2013.01); *E21B 7/02* (2013.01)

(58) Field of Classification Search

CPC . E02D 3/126; E02D 5/18; E02D 17/13; E02F 3/205; E02F 3/22; E02F 3/188; E02F 9/2232; E02F 9/226; E21B 7/02

USPC ..... 37/91, 92, 189, 195, 462; 175/91, 96, 175/263, 292; 405/282

See application file for complete search history.

(56) References Cited

U.S. PATENT DOCUMENTS 3,222,865 A 12/1965 Miller
3,222,866 A 12/1965 Lehmann
(Continued)

FOREIGN PATENT DOCUMENTS

EP 0249231 12/1987
EP 0790356 8/1997
(Continued)

OTHER PUBLICATIONS

Search Report issued in corresponding Italian Patent Application No. MI2014A000492, filed Mar. 24, 2014.

*Primary Examiner* — Robert E Pezzuto
(74) *Attorney, Agent, or Firm* — Lucas & Mercanti, LLP

(57) ABSTRACT

The invention includes digging equipment having a self-propelled base machine provided with an arm that supports a digging tool. The digging tool is provided with a device for crumbling soil. The digging tool is operatively connected to the base machine through a suspending flexible element that can be wound or unwound by a winch arranged on the base machine. The base machine also includes a main power engine, to actuate all the hydraulic apparatuses of the digging equipment, and a hydraulic system consisting of two independent and separate hydraulic circuits (S; U). A first hydraulic circuit (S) is configured to control and supply the main service apparatuses of the base machine, including a movement apparatus for moving the digging tool. A second hydraulic circuit (U) is configured to control and supply the main digging apparatuses of the digging tool, including at least the actuators of the device for crumbling soil.

11 Claims, 3 Drawing Sheets

(56) References Cited

U.S. PATENT DOCUMENTS

| | | | | |
|---|---|---|---|---|
| 7,363,733 | B2 * | 4/2008 | Stoetzer | E02D 17/13 175/96 |
| 7,367,143 | B2 * | 5/2008 | Stoetzer | E02D 17/13 175/91 |
| 7,559,161 | B2 * | 7/2009 | Stoetzer | E02F 3/205 175/91 |
| 8,020,323 | B2 * | 9/2011 | Chagnot | E02D 5/18 37/189 |
| 8,112,911 | B2 * | 2/2012 | Trevisani | E02D 3/126 175/263 |
| 2009/0165338 | A1 | 7/2009 | Chagnot et al. | |

FOREIGN PATENT DOCUMENTS

| | | |
|---|---|---|
| EP | 1452645 | 9/2004 |
| EP | 2302223 | 3/2011 |
| EP | 2532791 | 12/2012 |
| JP | H07138979 | 5/1995 |
| JP | 5442914 | 3/2014 |

* cited by examiner

DIGGING EQUIPMENT WITH RELATIVE IMPROVED HYDRAULIC SYSTEM

CROSS-REFERENCE TO RELATED APPLICATIONS

This application claims the benefit of Italian Patent Application No. MI2014A000492, filed Mar. 24, 2014.

FIELD OF THE INVENTION

The present invention refers to digging equipment for making deep diaphragm panels and, in particular, to the hydraulic system of such digging equipment. In greater detail, the present invention refers to digging equipment suitable for use in an urban environment with little spaces for maneuvering and for applications in which high power is required.

BACKGROUND OF THE INVENTION

In the field of foundations, in order to make impermeable or structural diaphragms, it is known to use digging equipment consisting of a base machine or "carrier", like for example a tracked crane or a drilling machine, equipped with tracks, which supports and moves an immersion digging tool equipped with hydraulic apparatuses like, for example, a cutter. The base machine is positioned on the surface of the soil, from which the digging begins, and is always kept outside of the excavation itself to support and manoeuvre the tool. Such hydraulic functions of the tool being immersed are carried out by hydraulic actuators fixed to the tool and operatively connected to the base machine through supplying hydraulic pipes. These actuators are also, along with the relative hydraulic supply pipes, immersed in the digging fluid.

The hydraulic actuators are thus subjected to an external pressure equal to the hydrostatic pressure of the stabilizing fluid and it is possible for the digging fluid, pushed by hydrostatic pressure, to penetrate into those components of the hydraulic circuit that are at lower pressure, therefore contaminating the oil of the hydraulic system despite the presence of pressure compensation devices. Such contamination or pollution, even in small percentage concentrations, drastically reduces the lubricant properties of the oil and causes series damage such as breaking or seizure of the hydraulic components of the equipment. This damage results in the loss of some hydraulic apparatuses for moving and for digging and, in the worst case scenario, makes it impossible to extract the immersed tool from the excavation. The restoration of such functionalities is particularly expensive, requiring the replacement of the components and of the oil and causing long machine down times.

An example of a known digging equipment for making deep diaphragms is shown in FIG. 1, where it is wholly indicated with reference numeral 100. The equipment 100 can be divided mainly into a base machine 2 and into one digging tool 3 supported by the base machine 2. The base machine 2 generally consists of a tracked truck 4, a tower 5 rotating with respect to the tracked truck 4 and one arm 6, generally able to tilt and hinged to the tower 5, which supports the digging tool 3 through a suspending flexible element 7 that can be wound or unwound through a winch 8. The base machine 2 is positioned on the surface of the ground, from which the digging begins, always stays outside of the excavation itself. The base machine 2 has the task of maneuvering the digging tool 3, positioning it on the digging site, and providing such a digging tool 3 with the power needed to dig the soil.

The base machine 2 also performs multiple service functions, of which the following are essential: the translation of the digging equipment 100 on the ground to move from one point in the building site to another, the movement of the arm 6 and of the tower 5 to position the digging tool 3 and the rotation of the winch 8 to lift or lower the tool 3 in the excavation. Such service functions are actuated by hydraulic actuators such as rotary motors or linear actuators installed on the base machine 2 and that always remain outside of the excavation.

The digging tool 3 generally consists of a cutter that is lowered into a pre-excavation of rectangular section. The pre-excavation is made with other digging equipment, like for example a bucket or a reverse boom excavator and, in order to avoid the walls crumbling, it is filled with stabilizing fluid that generally is a mud based on bentonite or polymers. The cutter consists of a prismatic frame 9 at the base of which two coil cutting devices for cutting the soil are arranged, like for example toothed drums 10, 11 rotating about parallel axes and actuated independently from hydraulic motors 12, 13. The hydraulic motors 12, 13 can be integrated in the toothed drums 10, 11, or they can be installed outside of them, fixed to the frame 9 and thus equipped with mechanical transmission for connecting to such toothed drums 10, 11.

The toothed drums 10, 11 break up (cut and crumble) the soil, ensuring the rectangular section of the excavation, and the debris broken up by the teeth in sufficiently small pieces is expelled from the excavation conveying it towards the surface through a submerged pump 14, also fixed to the frame 9 of the digging tool 3, which sucks it together with the stabilizing fluid with which the excavation is filled. The excavation fluid, therefore, can perform both a debris transportation function, and a stabilizing function of the excavation walls. Once it has reached the surface through the mud pipe of the pump 14, the excavation fluid is sent to suitable plants that take care of separating the solid part in suspension, whereas the liquid fraction is re-inserted into the excavation so as to always keep it full. In this way, the digging tool 3 advances removing soil up to the design depth, which in the most demanding applications can even exceed 200 meters.

In order to ensure that the excavation is sufficiently vertical, the cutter can be equipped with mobile flaps or shields 15 actuated by hydraulic cylinders 16. In this case, the frame 9 is very long (see FIG. 1). Alternatively, the frame 9 can be very compact in height if, for urban work or in low-height areas, the lowest possible bulk was required. The mobile shields 15, discharging a force against the walls of the excavation, can guide the digging direction so as to compensate for possible undesired deviations of the cutter.

The digging tool 3 thus performs multiple digging functions, including the following ones are essential: breaking up the soil through rotation of the cutting drums 10, 11, suction and transportation of the debris and correction of the digging direction. Such digging functions are actuated by hydraulic actuators, such as rotary motors or linear actuators, installed on the digging tool 3. These actuators are connected to the base machine 2 through hydraulic supply and discharge lines, also known as delivery and return lines, which supply the hydraulic power. The actuators of the digging apparatuses and the relative hydraulic lines are thus at least partially introduced into the excavation and immersed in the excavation fluid, and therefore are subjected to the hydrostatic pressure that, at the maximum depths reachable by the digging tools of this type, can be a few tens of bar. The digging tool, whilst being similar to that described up to now and thus equipped with at least one pair of toothed drums and a frame, can be used to break up the material and differ from the fact that it does not have a pump 14 installed. In this version the drums cut and break up the soil while a binding liquid is simultaneously inserted close to the wheels through a supply pipe coming from the outside. The action of the wheels pushes the soil mixed with the binder in a targeted manner above the frame. The tool can be guided with a rod or a "kelly". In a further variant, the mixing tool can be guided by the frame through noses or flaps that stay in contact with the wall.

In the case in which the gaskets of the actuators of the digging tool are not perfectly efficient, or when the pipes and the relative fittings are not perfectly water-tight, or even due to problems deriving from incorrect compensation of the actuators (for example due to vibrations or pulsating phenomena induced by the digging, or due to a temperature variation), there can be penetration of the fluid of the excavation inside the hydraulic circuit of the digging equipment. The critical points of the hydraulic circuit, where the penetration can occur most easily, are the sliding gaskets, the pipe fittings, which can loosen, or possible cracks and cuts that can appear on worn pipes. The problem is particularly evident on the oil return lines towards the tank and on the draining lines of the rotary actuators, since in these lines the pressure inside the pipe can be lower than the hydrostatic pressure of the fluid in which they are immersed. In high-pressure supply lines (delivery lines), on the other hand, there is the reverse problem, since oil can leak towards the environment outside the pipe, with consequent dispersion of oil in the excavation.

In base machines according to the prior art, designed for applications with a hydrocutter, there is a single power engine installed inside the tower (generally endothermal, but which could also be electric) that supplies power to all of the hydraulic apparatuses both of the base machine, and of the digging tool. Since the flow rate of oil required for these apparatuses is very high, it would not be possible to supply it with a single pump and therefore multiple pumps are provided, each of which is dedicated just to a part of the apparatuses of the digging equipment. Very frequently, through a coupler, all of the pumps of the system receive mechanical power from the single power engine and transform it into hydraulic power. All the pumps suck the oil from a single tank installed inside the tower, in which the oil returns after having actuated the actuators connected to such pumps. In this case, all of the hydraulic system of the digging equipment, i.e. both of the base machine and of the digging tool, consists of a single circuit. Therefore, considering a defined volume of oil, it can be sucked by the tank through a first pump, be sent to a first actuator, return to the tank, be sucked from the tank through a second pump, be sent to a second actuator different from the first and return to the same tank. It is thus clear that the entry of polluting agents in the circuit causes the pollution of the entire circuit and can block or damage any actuator or other hydraulic component of the digging equipment.

In digging equipment according to the prior art the worker becomes aware of the pollution of the oil having occurred only after the malfunction or the blocking of a given actuator. In this situation the worker must interrupt all manoeuvres as soon as possible, just limiting himself to those strictly necessary to extract the tool from the excavation and position it in an area sufficiently far from the excavation to allow the building site workers to access the digging tool. The only way to block the spread of the contamination to other actuators is interrupting the manoeuvres and stop the pumps to block the circulation of the oil in the circuit. The damage and the consequent blocking of the functionalities of the actuators due to the pollution of the oil can be particularly serious if, during digging, with the tool immersed at great depth, the lifting apparatuses of the tool block. If, for example, one of the malfunctioning actuators is the winch combined with recovering the cutter from the excavation, it becomes impossible to extract the digging tool using only the base machine and it becomes necessary to use a second support machine, which is not always available in the building site. This means additional costs and very long down times.

In digging equipment according to the prior art sometimes a machine originally designed to perform only lifting works and therefore not specifically intended for being used in couple with a digging tool like a cutter is used as base machine. In these cases, the power of the motor installed on the base machine is usually not sufficient to ensure the simultaneous operation of the apparatuses of the base machine and of the cutter. In order to solve the problem, solutions are known in which a so-called additional external "power-pack" 43 (FIG. 1) is installed on the base machine with an additional hydraulic circuit. A final piece of digging equipment is thus obtained that comprises at least two power motors, where the first power motor, installed inside the casing of the tower, is intended to supply power to the apparatuses of the base machine, whereas the second power motor, included in the external "power-pack" 43, is intended to supply power to the apparatuses of the cutter. The external "power-pack" 43 is fixed, through suitable additional support frames, on the rear part of the rotary tower of the base machine. It is then positioned close to the ballast or replacing it, considering its substantial weight. The external "power-pack" 43 is very bulky, with typical values of its dimensions of the order of 3.5 meters×1.5 meters×2 meters. This positioning thus increases the tail radius of the base machine, i.e. the rear overhang with respect to the rotation axis of the tower on the tracked truck. The tail radius determines the area that is swept by the base machine during the rotation of the tower and, therefore, the area that must be kept free from objects or people that could be struck during rotation. This increase in the tail radius constitutes a limitation particularly in urban cutters, in other words in those cutters studied for use in built up areas where the maneuvering spaces are particularly small.

A further critical element of the solution that provides an external "power-pack" 43 is the fact that the addition of a second external power motor inevitably causes an increase in consumption with respect to a solution dedicated to digging applications, with a single motor of suitable power. Moreover, the external positioning of the "power-pack" 43 with respect to the casing of the tower causes an increase in the noise emitted, which must be limited particularly in urban applications. The increase in weight due to the mounting of the external "power-pack" 43 increases the pressure on the soil of the tracks and this results in a limit in movement on the building site. Finally, the accessibility of the "power-pack" 43 is awkward since it is typically installed at a high level and the frequent necessary maintenance can be dangerous and not very easy.

SUMMARY OF THE INVENTION

The purpose of the present invention is therefore to make digging equipment for making panels of deep diaphragms, in particular the hydraulic system of such digging equipment, which is able to solve the aforementioned drawbacks of the prior art in a simple, cost-effective and functional manner.

In detail, a purpose of the present invention is to make digging equipment that is capable of minimising the possibility of the fluid in which the digging tool is immersed from being able to penetrate into the hydraulic system and pollute it, spreading inside it until it reaches the hydraulic components of the base machine that is outside of the excavation. In particular, if there is pollution of the oil, the hydraulic system of the aforementioned equipment must ensure that all of the service apparatuses of the base machine are operational, thus ensuring the possibility of extracting the immersed tool from the excavation.

Another purpose of the present invention is to make digging equipment that is able to provide an alarm signal to the operator whenever there is pollution of the oil of the circuit of the digging apparatuses, so that he can quickly interrupt the digging manoeuvres and avoid damaging the hydraulic components.

Further purposes of the present invention are to minimise the machine down times and to minimise the costs of restoring all of the digging apparatuses when there is pollution of the hydraulic oil. The invention also proposes to ensure all of the aforementioned advantages without increasing the bulks of the digging equipment and with minimal variations in weight, thus allowing the use thereof in urban environments with limited work spaces or for applications for which high power is required (deep or large section diggings). The digging equipment according to the invention also allows to maximise own energy efficiency, with a consequent saving of fuel or of other forms of energy for supplying the power motor, and to reduce the noise necessary for applications in residential areas.

These purposes according to the present invention are accomplished by making digging equipment for making panels of deep diaphragms, in particular the hydraulic system of such digging equipment, as outlined in claim 1.

Further characteristics of the invention are highlighted by the dependent claims, which are an integral part of the present description.

BRIEF DESCRIPTION OF THE DRAWINGS

The characteristics and advantages of digging equipment for making panels of deep diaphragms according to the present invention will become clearer from the following description, given as an example and not for limiting purposes, referring to the attached schematic drawings, in which.

DETAILED DESCRIPTION OF THE INVENTION

Figure 1:
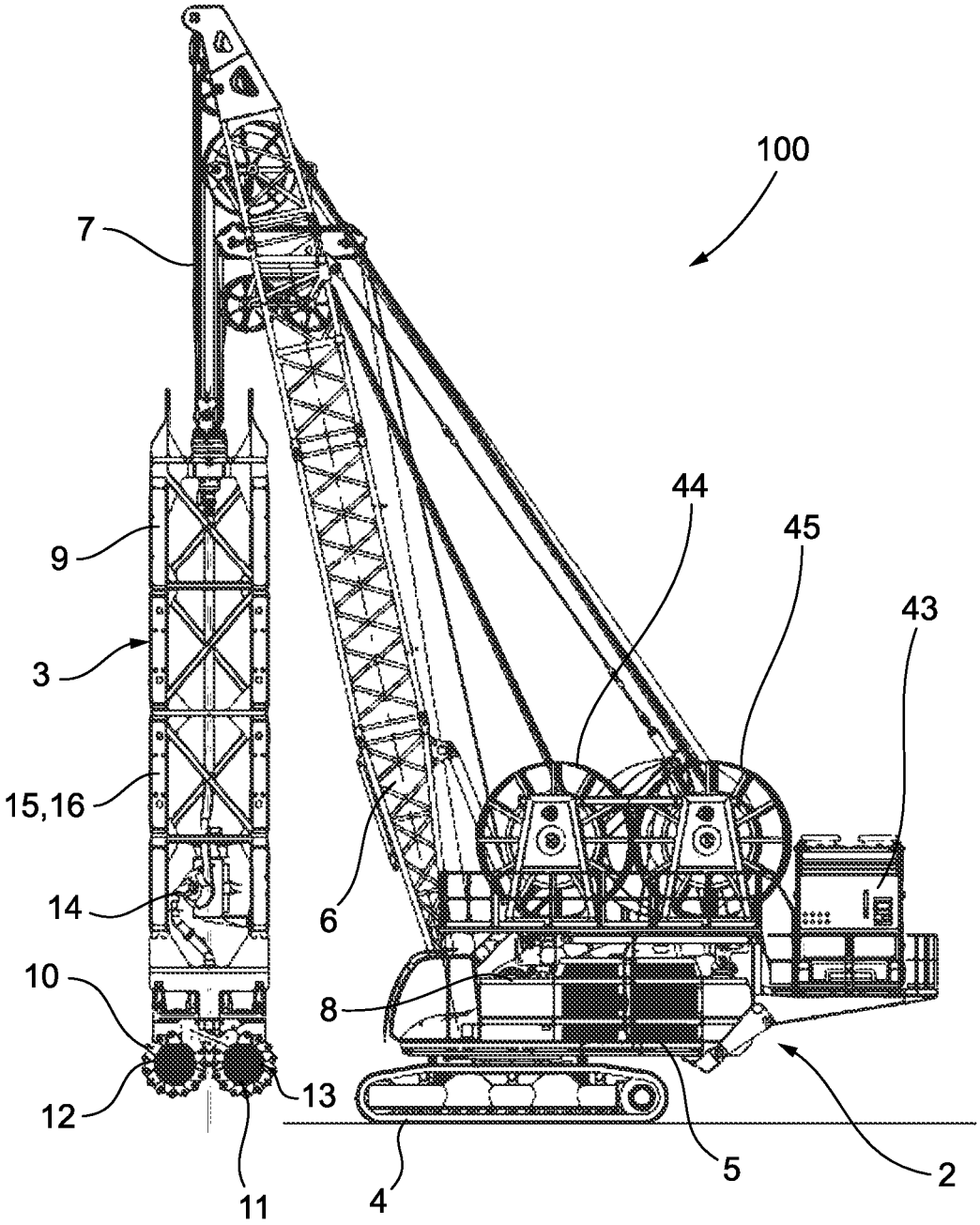
FIG. 1 is a perspective view of a known digging equipment for making diaphragms.
Figure 2:
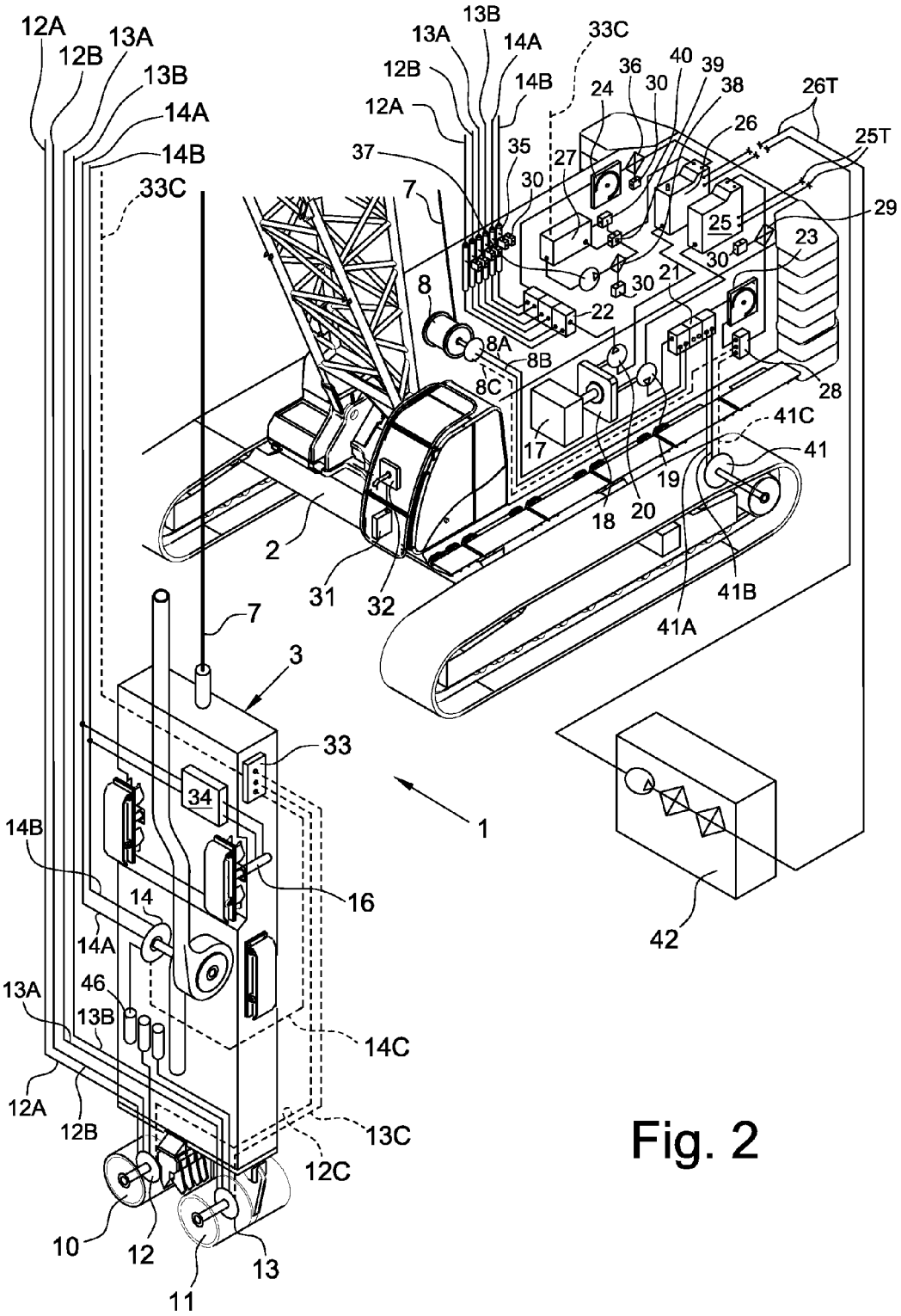
FIG. 2 is a perspective view of an embodiment of the digging equipment according to the present invention, with a schematic representation of the relative hydraulic system and of a device for filtering and recycling the oil, separate with respect to the digging equipment.
Figure 3:
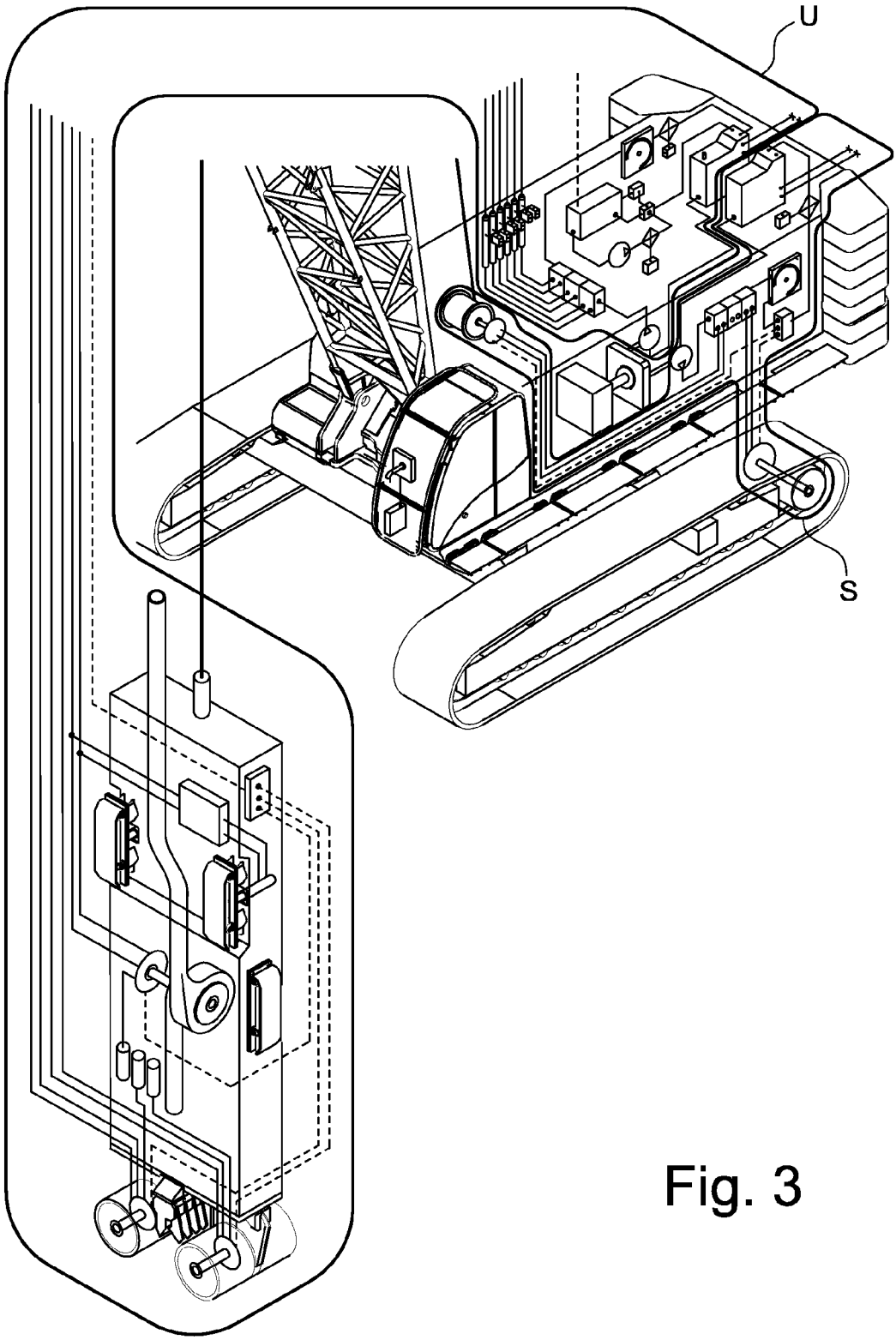
FIG. 3 highlights the two circuits U and S into which the hydraulic system of the digging equipment according to the present invention is divided.

With reference in particular to FIG. 2, it is specified that the details and the elements that are similar, or have an analogous function, to those of the known digging equipment described earlier and illustrated in FIG. 1 are indicated with the same reference numerals.

The digging equipment according to the present invention, wholly indicated with reference numeral 1, is made up of a base machine 2 and a crumbling or digging tool 3 operatively connected to the base machine 2. The base machine 2 comprises a tracked truck 4, a tower 5 rotating with respect to the tracked truck 4 and one arm 6, able to tilt and hinged to the tower 5, which supports the digging tool 3 through a suspending element 7 that is driven forwards by a winch. The suspending element 7 can be flexible, able to be directly wound or unwound through a winch 8. The winch 8 is installed on the base machine 2, inside or above the body, or fixed close to the winders 44 and 45, or furthermore directly connected to the arm 6.

Inside the rotating tower 5 of the base machine 2 a main power engine 17 is housed, preferably just one and of the endothermal type but which in alternative embodiments could also be electric. The main power engine 17 supplies the mechanical power required to actuate all the hydraulic apparatuses of the digging equipment 1, thus both the main service apparatuses, and the main digging apparatuses. It is clear that the insertion of a small power motor for secondary uses and with installation of minimum powers represents an equivalent to the described finding. The outlet shaft of the power engine 17 is connected to a coupler 18 equipped with a plurality of outlet shafts, to which it distributes the power received from the engine 17. The outlet shafts of the coupler 18 are connected to a plurality of pumps that can be divided into a first pump assembly 19, connected to a first hydraulic circuit S for controlling the service apparatuses, i.e. of the base machine 2, and a second pump assembly 20, connected to a second hydraulic circuit U for controlling the digging apparatuses, i.e. of the digging tool 3.

The hydraulic circuits S and U of the hydraulic system of the digging equipment 1 are separate and independent, which means that there is no hydraulic connection line between the two hydraulic circuits S and U that remains open during the digging manoeuvres. Each of the two hydraulic circuits S and U comprises hydraulic components that belong to just one of the two hydraulic circuits S or U, and therefore there are no hydraulic components that are common to both hydraulic circuits S and U, i.e. that are hydraulically connected to both the hydraulic circuits S and U during the digging manoeuvres. Consequently, the oil of one hydraulic circuit S or U never comes into contact with the oil of the other hydraulic circuit U or S and, in particular, it is not possible for a volume of oil initially contained in a first hydraulic circuit U or S to then pass into the second hydraulic circuit S or U. Each of the two hydraulic circuits S and U comprises at least one pump or a pump assembly, at least one actuator, at least one distributor or a control valve for controlling the actuators, at least one heat exchanger, at least one main tank for accumulating oil and at least the pipes necessary for connecting the aforementioned components. Each of the aforementioned hydraulic components and of the aforementioned pipes is connected exclusively to only one of the two hydraulic circuits S or U, i.e. no hydraulic component can belong to or be simultaneously connected to both the hydraulic circuits S and U. The hydraulic circuits S and U can be both of the open type, and of the closed type.

The first hydraulic circuit S for controlling the service apparatuses are connected to all of the actuators of the machine that control the service apparatuses and that are never introduced into the excavation, i.e. that never come into contact with the stabilizing fluid. In particular, the first hydraulic circuit S is connected to at least the winch 8 or the means directly involved in extracting the tool 3 from the excavation (for example one or more actuators for controlling the winders). Possible winders of the hydraulic pipes 44 or of the mud pipe 45 can be supplied independently from the winch 8, or be supplied through a diverting valve by the same line.

The second hydraulic circuit U, on the other hand, contains at least all of the supplies of the toothed drums 10, 11 and of the suction pump 14. The second hydraulic circuit U for controlling the digging apparatuses is connected to all of the actuators installed on the digging tool 3 that control and actuate the digging apparatuses and that are at least partially introduced into the excavation and immersed in the stabilizing fluid. These actuators that control the digging apparatuses are connected to the base machine 2 through hydraulic supply and discharge pipes 12A, 12B, 13A, 13B, 14A and 14B, also known as delivery and return lines, which supply the hydraulic power.

Thanks to this division of the circuits, the possibility according to which the stabilized fluid can penetrate inside the first hydraulic circuit S for controlling the service apparatuses is eliminated. Consequently, all of the hydraulic components of the first hydraulic circuit S are free from problems like for example mechanical breakings or seizures linked to the pollution of the oil by contaminants coming from outside the first hydraulic circuit S itself. A guarantee of the operation of the actuators of the first hydraulic circuit S, the efficiency of which is entirely dependent on the quality of the oil present in the second hydraulic circuit U, is therefore obtained. In the first hydraulic circuit S it is thus sufficient to carry out "simple" filtering of the oil using the solutions of the prior art. In the second hydraulic circuit U, which can be subject to pollution, on the other hand, more intensive filtering is carried out, adopting more complex and more efficient system solutions that will be described hereafter. Thanks to the division of the plant into two independent and separate circuits S and U, the intensive filtering can be carried out only on the second hydraulic circuit U instead of on the entire system, with all the advantages in terms of cost-effectiveness and ease of maintenance deriving from it.

The pump assembly 19 for the service apparatuses sucks the oil from the main tank 25 of the first hydraulic circuit S and sends it to the distributor 21, to which the actuators of the service apparatuses are connected. The pump assembly 19, the main tank 25 of the first hydraulic circuit S and the distributor 21 are installed on the base machine 2. The distributor 21 can be made up of many sections, or it can consist of multiple control valves each of which regulates the passage of oil towards the actuator through a high pressure delivery line and a low pressure return line. The actuator, in particular if it is of the rotary type, can also be equipped with a third low pressure draining line for disposing of the lubricant oil or the excess oil. It is also possible to have a plurality of distributors 21, each of which will be supplied by at least one respective pump of the pump assembly 19 and will be connected to an actuator of the first hydraulic circuit S for controlling the service apparatuses. There are generally many actuators connected to the first hydraulic circuit S of the service apparatuses, whether they are of the rotary type rather than of the linear type. Among these, for example, rotary motors for controlling the movement of the tracks of the truck 4, the rotation of the tower 5, the rotation of the winch 8 for moving the tool 3, the rotation of the maneuvering winches of the support arm 6 and the rotation of the winders for the hydraulic pipes and for the mud pipe. Again among the actuators connected to the first hydraulic circuit S, linear ones can control for example the inclinations of the arms or linkages, or move the stabilizers, or furthermore open the retractions of the tracks of the truck 4.

For the sake of simplicity FIG. 2 shows only two service actuators 8 and 41. The first actuator coincides with the rotary motor of the winch 8, which can wind or unwind the suspending element 7 causing the tool 3 to rise or descend in the excavation of the diaphragm. The second actuator is the rotary motor 41 that controls the movement of the tracks of the truck 4. The winch 8 is supplied by the distributor 21 through the lines 8A and 8B and is equipped with a draining line 8C. In the same way, the motor 41 is supplied by the distributor 21 through the lines 41A and 41B and is equipped with a draining line 41C. The hot and low pressure oil, which comes out from the actuators 8 and 41 and from all of the actuators actuated by the distributor 21, goes back to the distributor 21 and is then sent at least in part to the heat exchanger 23 to be cooled. The cooled oil coming out from the heat exchanger 23 is sent to a discharging collector 28 that can receive oil from a plurality of lines, connected even directly to the actuators, and preferentially conveys it into a single outlet line. The oil coming out from the discharging collector 28 of the first hydraulic circuit S of the service apparatuses crosses the filter at low pressure 29 to then end up in the main tank 25 of such a first hydraulic circuit S. From the main tank 25 the oil can be sucked again by the pump 19 to repeat the cycle just described. The function of the low pressure filter 29 is to collect the contaminating water particles, which can normally be present in small percentages in the hydraulic oil commonly on the market, and to collect possible solid contaminating particles, like for example the metallic or rubbery particulate produced by the wearing by friction of the mobile parts of the actuators. The action of the filter prevents these contaminating particles from reaching the main tank 25 and being reintroduced into circulation in the first hydraulic circuit S. The filter 29 is equipped with a clogging sensor 30 which is able to detect when the filter 29 has collected and trapped an excessive amount of contaminating particles and needs maintenance. The sensor 30, when it detects clogging, generates a signal that can be sent to a control unit 31 that, through at least one signalling device 32 arranged in the cabin, can generate an alarm or warning signal for the operator. The signalling device 32 can be a display and it can give indications on which filter is clogged. In a simpler alternative solution, the device 32 can be made of one or more indicator lights or of a sound indicator.

The pump assembly 20 for the digging apparatuses sucks the oil from the main tank 26 of the second hydraulic circuit U and sends it to the distributor 22, to which the actuators of the digging apparatuses are connected. The pump assembly 20 for the digging apparatuses, the main tank 26 of the second hydraulic circuit U and the distributor 22 are installed on the base machine 2. The distributor 22 can be made up of many sections, or it can consist of multiple control valves each of which regulates the passage of the oil towards the actuator through a high pressure delivery line and a low pressure return line. With reference to FIG. 2, the distributor 22 is connected to the digging apparatus actuators 12, 13 and 14 installed on the digging tool 3. The actuators 12 and 13 are rotary motors that actuate the rotation of the toothed drums 10 and 11 of the cutter. The actuator 14 is a suction pump of the muds of the excavation, which are sent to the surface through a dedicated flexible pipe, known as "mud pipe". The connection between the actuators 12, 13 and 14 and the distributor 22 takes place through supplying hydraulic pipes respectively indicated with the lines 12A, 12B, 13A, 13B, 14A and 14B. In a first digging condition, the hydraulic pipes 12A, 13A and 14A act as delivery lines and are supplied with oil at high pressure by the distributor 22 to actuate the actuators in one direction of rotation, whereas the hydraulic pipes 12B, 13B and 14B act as return lines and take the low pressure oil back towards the distributor 22 after having actuated the actuators. In a second operating condition, in order to reverse the direction of rotation of the motors 12 and 13 and of the cutting wheels 10 and 11, the distributor 22 can supply with high pressure oil the hydraulic pipes 12B and 13B which, in this case, act as delivery lines, whereas the hydraulic pipes 12A and 13A act as return lines and take the low pressure oil back towards the distributor 22 after having actuated the actuators. In all of the operating conditions, the oil of the return lines from the actuators, after having returned to the distributor 22, is at least partially sent to a heat exchanger 24 to be cooled. The cooled oil coming out from the exchanger 24 is sent to a low pressure filter 36 to then reach the main tank 26 of the second hydraulic circuit U of the digging apparatuses. From the main tank 26 the oil can be sucked again by the pump 20 to repeat the cycle just described.

The function of the low pressure filter 36 is to collect the contaminating particles possibly present in the oil coming out from the distributor 22 that controls the actuators of the digging apparatuses. The action of the low pressure filter 36 prevents these contaminating particles from reaching the main tank 26 and being reintroduced into circulation in the second hydraulic circuit U. The filter 29 is equipped with a clogging sensor 30, of the type already described, which is able to detect when the filter 29 itself has collected and trapped an excessive amount of contaminating particles and needs maintenance. The sensor 30, when it detects clogging, generates a signal that can be sent to a control unit 31.

The rotary actuators 12, 13 and 14 of the digging tool 3 each require a third low pressure draining line 12C, 13C and 14C to dispose of the lubricant oil or excess oil. It is provided for all of the drain fluids of the actuators of the digging tool 3, or at least those of two actuators, to be connected to a single discharging collector 33 fixed to the tool 3 and for the discharging collector 33 itself to convey all of the drain fluids in a unique return drain pipe 33C towards the base machine 2.

Having to follow the movement of the tool 3, the hydraulic pipes 12A, 12B, 13A, 13B, 14A, 14B and 33C and the "mud pipe" of the pump 14 must have a greater length than the maximum depth that can be reached and are preferably wound on winding devices 44 and 45 (FIG. 1) fixed to the base machine 2 and actuated by rotary actuators supplied by the first hydraulic circuit S of the service apparatuses. In order to limit the dimensions of the winding devices 44 and 45 and the complication of the system, it is necessary to limit to the minimum the number of supply lines that from the base machine 2 are sent to the digging tool 3. Consequently, when it is necessary to supply further actuators of digging apparatuses present on the tool 3, like for example the control cylinders 16 of the correction flaps 15 (when present) or, if present, the inclination cylinders of the support for the toothed drums 10 and 11 that can be inclined to carry out corrections along the longitudinal direction of the base machine 2 (parallel to the tracks) or, when the supports of the wheels are independent from each other, to also carry out angular corrections about the vertical axis of the digging tool 3 (inclining for example one drum forwards and the other backwards on the longitudinal plane), it is thus preferable to install on the tool 3 one or more control valves or solenoid valves 34 that do not need two dedicated supply lines but connect to two lines of another actuator, like for example the lines 14A and 14B, as shown in FIG. 2.

The hydraulic pipes 12A, 12B, 13A, 13B, 14A, 14B and 33C follow the movement of the tool 3 in the excavation and are at least partially immersed in the stabilizing fluid. As a result, in the presence of loose or damaged fittings or in the presence of cracks in the pipes, the stabilizing mud of the excavation pushed by the hydrostatic pressure can penetrate into the pipes, contaminating the oil. Compensation devices 46 are arranged on the frame 9 and are connected to the main actuators so as to restore the same external pressure inside them, which increases linearly with the depth and with the density of the fluid. Although these devices are simple, equipped with a membrane for the direct transduction of pressure, sometimes they may not be precise and, despite the presence of external pressure controls to correct the errors, there can be even momentary pressure imbalances, which in the long term damage the seal of the members in relative movement. This penetration of mud in the hydraulic circuit is more probable if the hydrostatic pressure is much greater than the pressure inside the pipe, so that the problem becomes increasingly serious as the depth of the excavation increases and hits the low pressure return lines and the drain lines mostly.

In order to limit the spread of polluting particles inside the second hydraulic digging circuit U at least one filter 35 is installed on each hydraulic pipe 12A, 12B, 13A, 13B, 14A and 14B. The filters 35 are suitable for working both at low pressure, and at high pressure and therefore operate correctly both when the respective line is used as delivery, and when the respective line is used as return. Moreover, in the case of mechanical breaking of one of the rotary motors of the tool 3, which are subjected even to strong mechanical stresses such as knocks, sliding and wear, the metallic particulate generated is trapped by the filters 35 present on the return lines of the oil towards the base machine 2. Each filter 35 is connected to a clogging sensor 30 of the type already described. Each of the sensors 30 can send a clogging signal to the control unit 31.

The penetration of contaminating particles, such as sand, water or mud, in the second hydraulic circuit U can also occur through the digging actuators, in particular rotary ones, where the sealing gaskets between the rotary parts are in direct contact with the stabilizing mud. These gaskets are lubricated exploiting a part of the oil entering the actuators, which is then discharged through the drain lines. If the sliding gaskets are not perfectly efficient, the contaminating particles can penetrate them and, in this case, are transported by the lubricant oil towards the inside of the drain lines.

The oil of the drain pipe 33C of the drains of the digging tool 3, which can be loaded with contaminating particles, is not sent directly to the main tank 26 of the second hydraulic circuit U of the digging apparatuses. The oil of the drain pipe 33C is preferably kept separate from the oil of the delivery and return hydraulic pipes 12A, 12B, 13A, 13B, 14A and 14B of the actuators. This oil is firstly sent to at least one secondary tank 27 of the second hydraulic circuit U, also called drain oil collection tank, and undergoes a series of filtering and cleaning cycles. The secondary tank 27 is installed on the base machine 2 in an easily accessible position for maintenance and is much smaller in size than the main tank 26, since the flow rate of the drain lines is much lower than that of the delivery and return lines of the digging actuators. The oil present in the secondary tank 27 is sucked by a recirculation pump 37 and is sent towards a low pressure filter 38, or preferably a battery of filters in series 38. The filter 38 is equipped with a clogging sensor 30, of the type already described, which is in turn electrically connected to the control unit 31. The filtered oil exiting from the filter 38 is sent to a two-position flow deviator 39, which sends it again inside the secondary tank 27 staying in a first operating position until such a secondary tank 27 is full. In these conditions, the secondary tank 27 receives oil both from the drain pipe 33C, and from the deviator line 39 and thus the oil accumulates in the secondary tank 27 until it reaches the maximum allowed level. The level of the oil is controlled by a level sensor 40 that is connected both to the secondary tank 27, and to the deviator 39. When the oil reaches the maximum level, the level sensor 40 sends a signal to the flow deviator 39, which is arranged in the second operating position and deviates the oil towards the main tank 26 of the second hydraulic circuit U, which is connected in series to the secondary tank 27. In particular, such a secondary tank 27 is positioned upstream of the main tank 26 and connected in series to it. In this condition, the secondary tank 27 starts to empty and the level of the oil falls until it reaches the minimum allowed level. When the minimum level is reached, the level sensor 40 sends a signal to the flow deviator 39, which is arranged in the first operating position and starts to deviate the oil towards the secondary tank 27 of the second hydraulic circuit U. Thanks to the connection in series between the secondary tank 27 and the main tank 26, the oil of the drain pipe 33C can reach the main tank 26 only after having undergone at least one filtering cycle through the filter 38. In this way, optimal cleaning of the oil is ensured and the possibility of contaminating particles being discharged into the main tank 26 and being reintroduced into circulation by the pump 20 is limited.

If there is contamination of the oil of the second hydraulic circuit U of the digging apparatuses, the first consequence is the clogging of one of the filters 35, 36 and/or 38 of the second hydraulic circuit U itself. The clogging is detected by one of the sensors 30 connected to the aforementioned filters 35, 36 and/or 38 and such a sensor 30 sends a signal to the control unit 31. The control unit 31, through at least one signalling device in the cabin 32, warns the operator of the presence of the problem. When the operator sees the alarm signal due to the clogging of a filter, he must stop all of the digging apparatuses as soon as possible to prevent the contaminating particles from spreading in the second hydraulic circuit U and being able to damage the actuators of such a second hydraulic circuit U. This function can be activated automatically by the control unit 31 that interacts directly with the system through electric activation and selection signals. The rotation of the cutting drums 10 and 11 and the rotation of the pump 14 is thus stopped. The hydraulic cylinders 16 are preferably equipped with return springs that cause them to close when such hydraulic cylinders 16 are not supplied. In this way, the flaps 15 disengage from the walls of the excavation when the digging apparatuses are not actuated, avoiding them being an obstacle due to being in contact with the wall, during the recovery manoeuvres of the tool 3 from the excavation.

All of the service apparatuses, on the other hand, remain able to be used by the operator without any limitation, since the first hydraulic circuit S that controls them is completely separate and distinct from the second hydraulic circuit U of the digging apparatuses. The use of the service apparatuses does not lead to the spread of the contaminating particles and, in particular, it is not possible for the contaminated particles present in the hydraulic circuit U of the digging apparatuses to also spread inside the first hydraulic circuit S of the service apparatuses. Consequently, the operator can proceed to extract the tool 3 from the excavation by winding up the suspending cable 7 through the winch 8 and can move the digging equipment 1 by actuating the motors 41 of the tracked truck 4. It is thus possible to proceed to the maintenance and cleaning of the filters and of the tanks.

Each of the main tanks 25 and 26 can be equipped with two pouring lines 25T and 26T through which it can temporarily be connected to a filtering and recycling device 42 of the oil (show in FIG. 2), preferably separate with respect to the digging equipment 1 but able to be associated with it. The connection can take place for example through hydraulic couplings, also of the quick type, positioned on the ends of the pouring lines. Such a filtering and recycling device 42 of the oil, also indicated with the term "kidney", substantially consists of a pump and a battery of filters arranged in series. The pump of the filtering and recycling device 42 of the oil sucks the oil from the main tank 25 and 26 through a first pouring line and sends it to the battery of filters that are connected in series and arranged with progressively increasing degrees of filtering. Once the battery of filters has been passed, the oil undergoes a reduction in the percentage of contaminating particles and is reintroduced into the respective main tank 25 or 26. The oil can then be sucked again by the filtering and recycling device 42 of the oil to undergo a new filtering cycle. In this way, following the entry of contaminating particles, all of the oil of the second hydraulic circuit U or of the first hydraulic circuit S can be filtered and cleaned by making it carry out a certain number of cycles passing through the filtering and recycling device 42 of the oil. The number of cycles must be sufficient to reduce the percentage of polluting elements below a limit value that allows the oil to be used again to supply the actuators. The percentage of polluting elements can be measured with a suitable sensor, arranged on the suction line of the oil from the respective main tank 25 or 26, before it reaches the pump of the filtering and recycling device 42 of the oil.

Based on the above, in the digging equipment 1 according to the present invention the separation between the first hydraulic circuit S for actuating the service apparatuses and the second hydraulic circuit U of the digging apparatuses is particularly advantageous since, in the case of penetration of contaminating elements in the oil of the second hydraulic circuit U, such contamination can spread only to the actuators and to the hydraulic elements of such a second hydraulic circuit U. The possible resulting damage is thus avoided and limited to the second hydraulic circuit U, whereas the first hydraulic circuit S and its actuators remain efficient and entirely unaffected by such contamination. As a result, there is a reduction in the restoration costs and time, with a substantial advantage with respect to the digging equipment of the prior art, in which the contamination can spread to all the parts of the hydraulic system and damage any of its components in an indiscriminate manner. The presence of a secondary tank 27, equipped with a dedicated filtering group 38, connected in series with the main tank 26 and positioned upstream with respect to the latter, allows the entry into the main tank 26 of contaminating materials to be limited. This allows to maintain better oil quality, increasing the oil replacement intervals and extending the lifetime of the hydraulic components of the circuit.

Maintaining the functionality of all the components of the first hydraulic circuit S, also in the case of contamination of the second hydraulic circuit U, is advantageous since it provides the guarantee of being able to quickly extract the tool 3 from the excavation using the service apparatuses of the apparatus 1, like for example the winding of the suspending cable 7 through the winch 8.

A further advantage deriving from the separation of the two hydraulic circuits S and U consists of the possibility of better control of the hydraulic work parameters of the digging tool 3, thanks to the fact that it has a dedicated hydraulic circuit U. Such parameters can be, for example, the pressures and the temperatures of the oil during operation.

A further advantage deriving from the separation of the two hydraulic circuits S and U consists of the possibility of using oils with different viscosity in the main tanks 25 and 26. In this way, each of the two hydraulic circuits S and U can have hydraulic lines with different characteristics, so as to maximise the performances of the digging tool 3 and, at the same time, keep down the costs thanks to the use of the most expensive solutions only on the second hydraulic circuit U of the digging apparatuses.

The presence of multiple filters, each equipped with a clogging sensor 30 connected to a control unit 31, is particularly advantageous since it allows to detect even small amounts of pollution and to accurately localise the line in which the pollution occurred. In this way, the replacement and repair interventions are faster and more cost-effective, drastically reducing the machine down times.

The use of a single engine 17 present in the tower 5 of the base machine 2 to supply all of the necessary power both to the first hydraulic circuit S of the service apparatuses, and to the second hydraulic circuit U of the digging apparatuses is advantageous, since it eliminates the need for an external "power-pack" and allows to keep the dimensions of the base machine 2 compact, limiting the weights. This translates into greater maneuverability in urban environments, into a reduction of the pressure on the soil and into a reduction of the transportation costs. The absence of an external "power-pack" clearly translates into a saving of the cost of the "power-pack" itself. Moreover, it leads to a simplification of the hydraulic system, which is less bulky and has lower maintenance costs. It is also simpler and more cost-effective to mount the digging equipment 1, since it is not necessary to install supports for supporting the external "power-pack".

The use of a single power engine 17 is also advantageous in terms of consumption, thanks to a greater combustion efficiency with respect to the solutions of the prior art that provide two motors, one of which is in the base machine and one in the "power-pack". The use of a single power engine 17 also allows its positioning inside the tower 5 and is advantageous since it allows a reduction of the sound emissions ensured by the casing of the tower 5 itself.

The possibility of connecting the main tanks 25 and 26 to a filtering and recycling device 42 of the oil is advantageous, since it allows to not replace all of the contaminated oil of the main tank 25 and/or 26 with an equal amount of new and clean oil. Indeed, the complete replacement of the polluted oil, provided in the technical solutions according to the prior art, is very expensive since the tanks of this digging equipment can contain a few thousand liters of oil. Moreover, the replacement of just the oil of one tank would not solve the problem, since in the remaining pipes of the hydraulic circuit a large amount of contaminated oil would remain. For these reasons it is advantageous for the main tanks 25 and 26 to be mounted on the base machine 2 and arranged close to its outer perimeter, so that they can be easily reached, inspected and connected to the external filtration devices.

In equipment for deep digging, due to the length and the high section of the supply pipes of the digging tool, the amount of oil present in the pipes of the circuit can even be two or three times greater than the capacity of the tank. Therefore, in machines according to the prior art, by actuating the actuators after the replacement of the oil of the tank, a mixing of the clean oil of the tank with the contaminated oil of the circuit is obtained and the resulting mixture, generally, still has a degree of contamination that is too high to ensure correct operation of the actuators. In these cases, it is necessary to further replace all of the oil of the tank, with consequent additional costs. The solution proposed by the present invention, on the other hand, allows to carry out the filtering and cleaning of the oil of the main tanks without requiring the replacement of the oil itself, with a substantial economic saving.

It has thus been seen that the digging equipment according to the present invention achieves the purposes outlined earlier.

The digging equipment of the present invention thus conceived can in any case undergo numerous modifications and variants, all of which are covered by the same inventive concept; moreover, all of the details can be replaced by technically equivalent elements. For example, the main tanks 25 and 26 can be contiguous and obtained starting from a single external container by dividing its internal volume into two parts through a dividing wall, so as to obtain two distinct volumes that do not communicate with each other. The base machine 2 could consist of a drill with a vertical arm and the cutter would remain suspended and free through cables, or guided by means of shafts and guide devices fixed to the arm itself.

In an alternative embodiment of the invention, the digging tool 3 can consist of the same crumbling drums 10 and 11 described above, the cutting actions of which are associated with those of a binder that is introduced under pressure through the body of the tool 3, as close as possible to the excavation. The digging tool 3 thus does not have an installed pump, but the piping 14 is in this case of smaller diameter and is more resistant to pressure, since it is used to inject the binder under low or high pressure. Said piping can also be contained inside a rod that brings the tool to depth. The digging tool is also operatively connected to the base machine 2 through a suspending flexible element 7 that can be wound or unwound through a winch 8 arranged on the base machine 2. The drums 10 and 11 are in this case also given the mixing function between broken up soil and binder, in order to reach the correct homogeneity of the mixture. The injection of the binder increases the possibility of the seals not being able to withstand the pressure and the abrasive action. Generally, cement grout, mixtures of cement grout with bentonite or chemical mixtures are used as a binder agent. In this case, therefore, the protection of the motors and of their drains should be prioritised, especially since these types of digging tools are often not equipped with correction flaps. Therefore, the system described earlier must consist of a first hydraulic circuit S, totally similar to the one described up to now, and of a second hydraulic circuit U that, instead, consists of just the main lines of the rotation motors of the drums 10 and 11. The tool 3 can be either guided by the arm 6 or be suspended. When it is guided, the tool 3 is usually connected to a rod that is used for pulling, driving in and orienting the tool 3 itself.

In practice, the materials used, as well as the shapes and sizes, can be whatever according to the technical requirements. The scope of protection of the invention is therefore defined by the attached claims.

The invention claimed is:

1. Digging equipment comprising:

a self-propelled base machine provided with at least one arm supporting at least one digging tool, in turn provided with at least one device for crumbling soil, the digging tool being operatively connected to the base machine through a suspending flexible element which can be wound or unwound by means of a winch located on said base machine, said base machine further comprising a main power engine for supplying mechanical power required to actuate all hydraulic apparatuses of the digging equipment, and a hydraulic system with two independent and separate hydraulic circuits (S; U), wherein a first hydraulic circuit (S) is configured to control and supply main service apparatuses of the base machine, the first hydraulic circuit (S) comprising at least one service actuator for a movement apparatus adapted to move the digging tool, and at least one distributor or control valve for controlling the at least one service actuator, wherein a second hydraulic circuit (U) is configured to control and supply main digging apparatuses of the digging tool, the second hydraulic circuit (U) comprising at least one digging tool actuator for the device for crumbling soil, and at least one distributor or control valve for controlling the at least one digging tool actuator, wherein each of said two independent and separate hydraulic circuits (S; U) respectively further comprises at least one pump assembly, at least one heat exchanger, and at least one main tank for accumulating oil arranged on the base machine, and wherein each of said two independent and separate hydraulic circuits (S; U) receives the mechanical power required to actuate each respective pump assembly from the main power engine of the base machine.

2. The digging equipment according to claim 1, wherein the second hydraulic circuit (U) is provided with a discharging collector, fixed to the digging tool, adapted to collect drain fluids of the at least one digging tool actuator of the digging tool, said discharging collector being adapted to convey the drain fluids in a unique return drain pipe towards the base machine, said drain fluids being kept separated from oil supplied to the at least one digging tool actuator by the second hydraulic circuit (U) using supplying hydraulic pipes.

3. The digging equipment according to claim 2, wherein the second hydraulic circuit (U) is provided with at least one secondary tank adapted to receive the drain fluids, said at least one secondary tank being separated from the at least one main tank for accumulating the oil of the second hydraulic circuit (U) and being connected in series to said at least one main tank.

4. The digging equipment according to claim 3, wherein the at least one secondary tank is installed upstream of the at least one main tank.

5. The digging equipment according to claim 3, wherein the at least one main tank or the at least one secondary tank of the second hydraulic circuit (U) are respectively provided with a filter having a clogging sensor for detecting when said filter has collected and trapped an excessive amount of contaminating particles and requires maintenance.

6. The digging equipment according to claim 2, wherein each of the supplying hydraulic pipes operatively connected to the at least one digging tool actuator has at least one filter is installed, suitable for operating both under low and high pressure, said at least one filter being capable of limiting polluting particles spreading inside said second hydraulic circuit (U).

7. The digging equipment according to claim 6, wherein each at least one filter of each of the supplying hydraulic pipes is operatively connected to a respective clogging sensor.

8. The digging equipment according to claim 5, further comprising a control unit operatively connected to each clogging sensor, said control unit being capable of generating and sending an alarm or warning signal through at least one signalling device thereby identifying that the respective filter is clogged.

9. The digging equipment according to claim 1, wherein each at least one main tank for accumulating oil is provided with two respective pouring lines through which said at least one main tank can be temporarily connected to a device for filtering and recycling oil separated with respect to the digging equipment.

10. The digging equipment according to claim 1, further comprising at least one means for suctioning and ejecting crumbled debris from an excavation by said at least one device for crumbling soil, wherein the second hydraulic circuit (U) is configured to control and supply the at least one digging tool actuator operatively connected to said at least one means for suctioning and ejecting crumbled debris.

11. The digging equipment according to claim 1 wherein the device for crumbling soil is configured to mix soil with a binding material introduced by the digging tool through a pressurized pipe wherein said digging tool is brought to a depth by a rod.

* * * * *